US007218703B2

(12) United States Patent
Yada et al.

(10) Patent No.: US 7,218,703 B2
(45) Date of Patent: May 15, 2007

(54) X-RAY MICROSCOPIC INSPECTION APPARATUS

(75) Inventors: Keiji Yada, Tokyo (JP); Hiromi Kai, Tokyo (JP); Yasushi Saito, Tokyo (JP)

(73) Assignee: Tohken Co., Ltd., Tokyo (JP)

( * ) Notice: Subject to any disclaimer, the term of this patent is extended or adjusted under 35 U.S.C. 154(b) by 267 days.

(21) Appl. No.: 10/719,008

(22) Filed: Nov. 21, 2003

(65) Prior Publication Data

US 2005/0111624 A1 May 26, 2005

(51) Int. Cl.
*G21K 7/00* (2006.01)

(52) U.S. Cl. ..... 378/43; 378/136

(58) Field of Classification Search ..... 378/43, 378/136, 122–124, 137, 138
See application file for complete search history.

(56) References Cited

U.S. PATENT DOCUMENTS

| | | | | |
|---|---|---|---|---|
| 4,315,152 | A * | 2/1982 | Smith | 250/396 ML |
| 4,544,845 | A * | 10/1985 | Michel | 250/396 R |
| 4,629,898 | A * | 12/1986 | Orloff et al. | 250/396 R |
| 5,044,001 | A * | 8/1991 | Wang | 378/43 |
| 5,317,574 | A * | 5/1994 | Wang | 372/5 |
| 5,602,899 | A | 2/1997 | Larson | 378/143 |
| 6,282,263 | B1 | 8/2001 | Arndt et al. | 378/138 |
| 6,430,254 | B2 * | 8/2002 | Wilkins | 378/43 |
| 2001/0001010 | A1 | 5/2001 | Wilkins | 378/43 |
| 2002/0130039 | A1 * | 9/2002 | Hojoh et al. | 204/275.1 |

FOREIGN PATENT DOCUMENTS

| | | |
|---|---|---|
| DE | 100 29 840 | 1/2001 |
| EP | 0 473 227 A2 | 3/1992 |
| GB | 735943 | 8/1955 |
| GB | 865050 | 4/1961 |
| GB | 2 131 224 | 6/1984 |

(Continued)

OTHER PUBLICATIONS

U.S. Appl. No. 10/719,887, filed Nov. 21, 2003, Yada et al.
Nixon, W.C., "High-Resolution X-Ray Projection Microscopy," *Proc. Roy. Soc.*, A232, pp. 475-485 (1960).

(Continued)

*Primary Examiner*—Edward J. Glick
*Assistant Examiner*—Elizabeth Keaney
(74) *Attorney, Agent, or Firm*—Ladas & Parry LLP

(57) ABSTRACT

To provide an X-ray microscopic inspection apparatus capable of performing non-destructive inspection with high resolving power equal to or less than 0.1 μm in a very short period, and largely contributing to the nano-technology field.

In the X-ray microscopic inspection apparatus having X-ray generating means for generating an X-ray by allowing an electron beam from an electron source to impinge on a target for X-ray generation, for inspecting an object to be inspected by utilizing the X-ray, a magnetic field superposition lens having a magnetic field generating portion disposed in the vicinity of an electron generating portion of an electron gun is included as a component element of the X-ray generating means. Further, the apparatus includes a liquid metal electron source using liquid metal or a thermal field emission electron source as the electron source, as a component element of the X-ray generating means. Furthermore, the apparatus includes a target with a heat sink using CVD diamond as the heat sink as the target for X-ray generation, as a component element of the X-ray generating means.

8 Claims, 5 Drawing Sheets

FOREIGN PATENT DOCUMENTS

| | | | |
|---|---|---|---|
| JP | 2004-138460 | | 5/2004 |
| WO | 01/15192 | A1 | 3/2001 |
| WO | 03/065772 | A2 | 8/2003 |

OTHER PUBLICATIONS

Yada, K., et al., "Development of Projection X-Ray Microscopy and Its Biological Applications," *Bulletin of Aomori Public College*, vol. 1, pp. 2-13 (1996).

Yada, K., et al., "Development of Soft X-Ray Microscopy," *Biophysics*, vol. 33, No. 4, pp. 8-16 (1980).

Yada, K., et al., "High-Resolution Projection X-Ray Microscopy," *Multidimensional Microscopy*, Chapter 8, pp. 133-150 (1994).

Yada, K., et al., "Projection X-Ray Shadow Microscopy Using SEM," *Bulletin of the Research Institute for Scientific Measurements*, Tohoku University, vol. 29, No. 1, pp. 25-42 (1980).

Delong, A., et al., "A New Design Of Field Emission Electron Gun With A Magnetic Lens," *Optik*, vol. 81, No. 3, pp. 103-108 (1989).

Mayo, S.C., et al., "X-Ray Phase-Contrast Microscopy and Microtomography," *Optics Express*, vol. 11, No. 19, pp. 2289-2302 (Sep. 2, 2003).

* cited by examiner (A)

(B)

X-RAY MICROSCOPIC INSPECTION APPARATUS

BACKGROUND OF THE INVENTION

1. Field of the Invention

The present invention relates to an X-ray inspection apparatus, and specifically, to an X-ray microscopic inspection apparatus capable of providing better resolution than 0.1 μm over a broad range of an accelerating voltage by using an electron source for emitting a high intensity electron flow and a lens system for focusing electrons on the X-ray target.

2. Description of the Related Art

As an inspection apparatus utilizing an X-ray, various kinds of industrial inspection apparatuses such as an X-ray microscope, a foreign body inspection apparatus, a fluorescent X-ray analyzing apparatus, and medical X-ray apparatuses such as an X-ray diagnostic apparatus are known. FIG. 1 shows a construction example of a conventional X-ray inspection apparatus. The X-ray inspection apparatus in this example is designed so as to obtain a micro X-ray point source 23*a* by accelerating electrons Re from an electron source 21*b* by applying a high voltage between a grid 21*a* and an anode 21*c* using a thermionic emission cathode 21*b* as the electron source, and then focusing the electrons Re on a target 23 formed by a thin plate of high-melting point metal such as tungsten by electron lenses 22. Subsequently, the inside of a sample (object to be inspected) 10 is projected in magnifying mode by using the point-form X-ray Rx generated from the X-ray targets 23*a* and the microstructure inside of the sample is subjected to non-destructive perspective inspection.

In such X-ray inspection apparatus, the electron beam Re impinging on the target 23 is converted into the X-ray Rx thereon, however, its conversion efficiency is as extremely low as equal to or less than 1%, and most of the energy of the electron beam Re is converted into heat on the target 23. By the way, since an X-ray has no electric charge, it can not be bent freely as an electron by using an electron lens. On this account, in order to obtain high magnifying power, it is necessary to bring the sample 10 as near to the X-ray source 23*a* as possible, to capture the X-ray Rx that is transmitted through the sample 10 and spreads out radially with a two-dimensional detector (X-ray detector) 24 disposed at a distance as far as possible, and to make it into an image (there are various kinds of X-ray detectors 24, and an X-ray is converted into light and subjected to amplification and imaging). Only in theory, the magnifying power is infinitely increased as the distance between the sample 10 and the X-ray detector 24 is taken larger, however, actually, since the X-ray amount per unit area is reduced in inverse proportion to the square of the distance, the upper limit of the magnifying power is determined by the balance between the sensitivity of the X-ray detector 24 and the X-ray amount or X-ray density on the X-ray detector of the magnified image.

On the other hand, the resolving power of the X-ray image transmitted through the sample 10 is more improved by making the X-ray source size (focal point size) smaller because the blurring amount is reduced. In the case where the same electron source 21*b* is used, the X-ray source size can be made smaller by focusing the electron into a small spot by the electron lens 22, however, since the electron beam amount included therein is reduced in reverse proportion to the square of the spot diameter and the X-ray amount is also reduced in response thereto, the final resolving power is determined by the balance between the electron spot diameter in which enough X-ray amount is produced and the sensitivity of the above described X-ray detector 24, and has a certain limit. In the conventional X-ray microscopic inspection apparatus that the applicant has developed and commercialized, a two-stage reduction system using lenses having as small spherical aberration and chromatic aberration as possible for the focusing lens system and a $LaB_6$ (lanthanum hexaboride) cathode having an advantageous character as a thermionic source are adopted, and further, an image intensifier with high sensitivity is used, and thereby the resolving power becomes less than 1 μm and achieves about 0.4 μm. This is the highest value on a global basis as a practical X-ray inspection apparatus at present (the degree of 0.1 μm is the highest value if the exposure time is neglected), and the value may be assumed as the technical limit under the present circumstances. Therefore, the resolving power better than 0.1 μm expected in the invention can not be implemented by the conventional technology (see the following description of the non-patent documents).

Hereinafter, the conventional technology concerning the resolving power of the X-ray inspection apparatus will be described.

The technology concerning the resolving power is disclosed in Non-patent Document 1, Nixon, "High-resolution X-ray projection microscopy", 1960, A232: pp. 475-485, Non-patent Document 2, Keiji Yada & Hisashi Ishikawa, "Projection X-ray Shadow Microscopy using SEM", Bulletin of the Research Institute for Scientific Measurements, Tohoku University, 1980, Vol. 29, No. 1, pp. 25–42, Non-patent Document 3, Keiji Yada & Kunio Shinohara, "Development of Soft X-ray Microscopy", 1980, Biophysics, Vol. 33, No. 4, pp. 8–16, Non-patent Document 4, Keiji Yada & Shoichi Takahashi, "High-Resolution Projection X-ray Microscopy", 1994, Chap. 8, pp. 133–150, and Non-patent Document 5, Keiji Yada & Kunio Shinohara, "Development of Projection X-Ray Microscopy and Its Biological Applications" 1996, Bulletin of Aomori Public College, Vol. 1, pp. 2–13, for example. In Non-patent Document 1, there described that, regarding X-ray Shadow Microscopy, the limit of its resolving power has been 0.5 μm conventionally, however, the resolving power of 0.1 μm is achieved by using a high brightness electron emitter and a very thin metal film (0.1 μm in thickness) as the target at this time. In addition, there also described that the exposure time for obtaining a sheet of image is five minutes, and after Non-patent Document 1 is disclosed, studies for shortening the exposure time have been actively performed. Further, Non-patent Document 2 is a research report (bulletin of the research institute for scientific measurements, Tohoku University) on the projection X-ray shadow microscopy utilizing an irradiation system of an electron microscope, and there described that the resolving power of 0.1 μm is achieved. Additionally, theoretical analyses are performed regarding respective factors that affect the resolving power, and there derived the conclusion that the spot size of the X-ray source exerts the greatest effects on the resolving power. Furthermore, there described that, by converting a SEM (scanning electron microscope) to an X-ray microscope, scanning of the electron beam with a deflection coil is utilized for focusing.

Moreover, Non-patent Document 3 is for explaining the trend in the X-ray microscopy to the present, and there explained that the soft X-ray microscope of a relatively short wavelength (0.1 to 10 nm) by specifically referring to the observation of biological samples. The contents of Non-patent Document 4 are substantially the same as those of Non-patent Document 2, however, there shown a densitometry profile of an X-ray image having the resolving power better than 0.1 μm (on 146 page in the main body). Non-patent Document 5 is for explaining the X-ray microscope in an easily understandable way, and there described that the image quality becomes better by changing the target in relation to the sample that is difficult to provide contrast as is the case with Non-patent Documents 2, 3, and 4.

In order to manufacture an X-ray inspection apparatus having high power resolution never before possible, an electron source with higher brightness (greater current amount per unit area/unit solid angle) and greater emission current amount becomes required. Additionally, an electron lens system for assuring a great electron probe current amount as possible becomes also required. Further, devices for increasing the heat release effect of the target are required so that the target may not melt or evaporate even if the electron probe having such high current density impinges thereon.

By the way, the nano-technology extends across information, medical, environmental fields, and, for example, in a micromachine referred to in the medical field, the component constituting the machine becomes less than 1 μm and ready to enter nano order. In addition, the current semiconductor technology is ever being directed to miniaturization, and non-destructive inspection in the class of the resolving power equal to or less than 0.1 μm never before possible using the micro X-ray source becomes a challenge that is required by all means. Especially, in the information field, there is the great challenge of making the line width in the next generation very large scale integrated circuit from 180–130 nm at present to 70–100 nm. Simultaneously, it is often the case where the microstructure consisted principally of a light element become an object to be observed, and, for providing contrast to the image, it becomes an important challenge that the high resolution power is held even in the case of using an X-ray having a long wavelength by the low accelerating voltage of 10 to 20 kV, which has been difficult in the conventional X-ray inspection apparatus.

The invention is achieved in the light of the above described circumstances, and an object of the invention is to provide an X-ray microscopic inspection apparatus for solving the above described various challenges, enabling non-destructive inspection with high resolving power equal to or less than 0.1 μm within a very short period, and capable of largely contributing to the nano-technology field.

SUMMARY OF THE INVENTION

The invention relates to X-ray microscopic inspection apparatus having X-ray generating means for generating X-rays by allowing an electron beam from an electron source to impinge on a target for X-ray generation, for inspecting an object to be inspected by utilizing the X-rays, and the above described object of the invention is achieved by including a magnetic superposition lens whose magnetic lens-field is superposed on an electron generating portion of en electron gun, as a component element of the X-ray generating means. Further, the object is achieved by including a liquid metal electron source using Taylor cone consisting of the liquid metal, as a component element of the X-ray generating means. Furthermore, the object is achieved by including a thermal field emission electron source as the electron source, as a component element of the X-ray generating means. Moreover, the object is achieved by including a target with a backing plate using CVD diamond as the heat sink, as a component element of the X-ray generating means.

In addition, the object is achieved even more effectively by including at least one component element of an electron source using liquid metal or a thermal field emission electron source as the electron source, and a target with a CVD diamond plate as the heat sink of the target, as a component element of the X-ray generating means, other than the magnetic superposition lens disposed in the vicinity of the electron generating portion of the electron gun.

BRIEF DESCRIPTION OF THE DRAWINGS

FIG. 4A is a front view; and FIG. 4B is a side view.

FIG. 7A is a side view; and FIG. 7B is a plan view.

DETAILED DESCRIPTION OF THE PREFERRED EMBODIMENT

Figure 1:
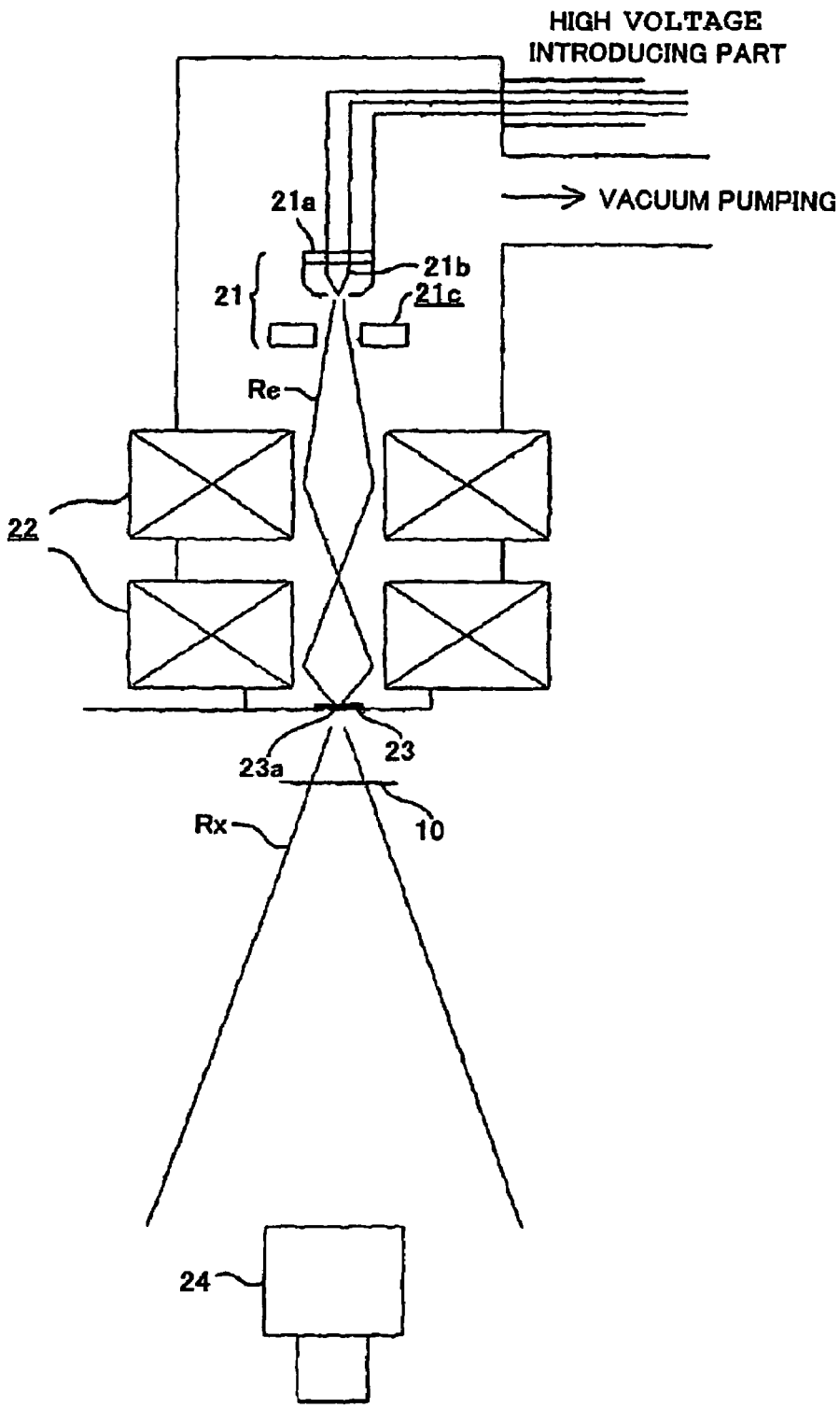
FIG.1 (Prior Art)
FIG. 1 is a diagram showing an example of a construction of a conventional X-ray inspection apparatus.

In an X-ray microscopic inspection apparatus of the invention, the following means are adopted in order to solve the various problems as described in "Description of the Related Art". First, "thermal field emission cathode" or "liquid metal field emission cathode" with higher brightness compared to the thermionic emission cathode used in the conventional X-ray inspection apparatus is used for the electron source for the first time in the X-ray microscopic inspection apparatus. The characteristics of these electron sources are that the brightness is higher than the $LaB_6$ cathode by two orders of magnitude, and simultaneously, the effective size of the electron source is smaller by three orders of magnitude. On this account, special devices are required for the electron optical system that forms an electron probe. In the conventional X-ray inspection apparatus, as shown in FIG. 1, the electron probe has been reduced totally by two orders of magnitude by accelerating the electrons Re from the electron source 21*b* and then focusing them by the electron lenses 22. This probe size reduction accompanies the reduction of the electron beam amount as described above. Therefore, secondly, in the X-ray microscopic inspection apparatus of the invention, operating at a magnifying mode of several times totally while reducing the electron beam loss amount by introducing a magnetic superposition electron lens (hereinafter, referred to as "magnetic superposition lens") for focusing electrons while accelerating them is adopted. Thus, a high intensity X-ray source never before possible is realized by using the electron source (thermal field emission cathode, liquid metal electron source) that has never been used for the X-ray microscope and the magnetic superposition lens that has never been used for the X-ray microscope, either, and an X-ray image with high resolving power of equal to or better than 0.1 μm can be obtained within a very short period.

Thirdly, to the target for X-ray generation, a thin plate of diamond formed by CVD (chemical vapor deposition) is introduced as a heat sink. Diamond is a light element and has good X-ray transparency, and has extremely high thermal conductivity (about three times that of pure copper) despite that it is an insulative material and extremely high melting point. Recently, a diamond plate of good thermal conductivity can be obtained by CVD. In the embodiment, by using a target with a diamond heat sink as the target by further depositing a target material on the diamond plate by CVD, the temperature rise of the target due to the electron beam is largely reduced, and the target is made to endure thermal load even in the case where the X-ray converted from the electron beam is largely increased. The surface of diamond plate is kept electrically conductive with a suitably material in use such as thin deposition layer of Be. It is optimum to adopt all of the above described first to third technical matters, however, they can be adopted independently, and any of them can be used for providing an X-ray image with higher resolving power.

By the way, it has been known that X-rays having long wavelength is desirable for a sample consisting principally of light elements, however, since the conventional X-ray microscopic inspection apparatus is short of the signal amount, there has been only a method of contrast intensification by image processing. In the X-ray microscopic inspection apparatus of the invention, since the signal amount can be increased largely by adopting the respective technical matters as described above, the light element sample can be inspected with high resolving power using X-rays having long wavelength. For example, the accelerating voltage is lowered to the order of 10 to 20 kV, and Ge (germanium), Cr (chromium), etc. is adopted as a target corresponding thereto to generate a characteristic X-ray having a wavelength of 0.2 to 3 nm, in addition to a continuous X-ray having a wavelength of 0.06 to 0.2 nm. The apparatus can perform significant contrast enhancement to X-ray images of the samples consisting principally of light elements.

Hereinafter, preferable embodiments of the invention will be described in detail by referring to the drawings.

Figure 3:
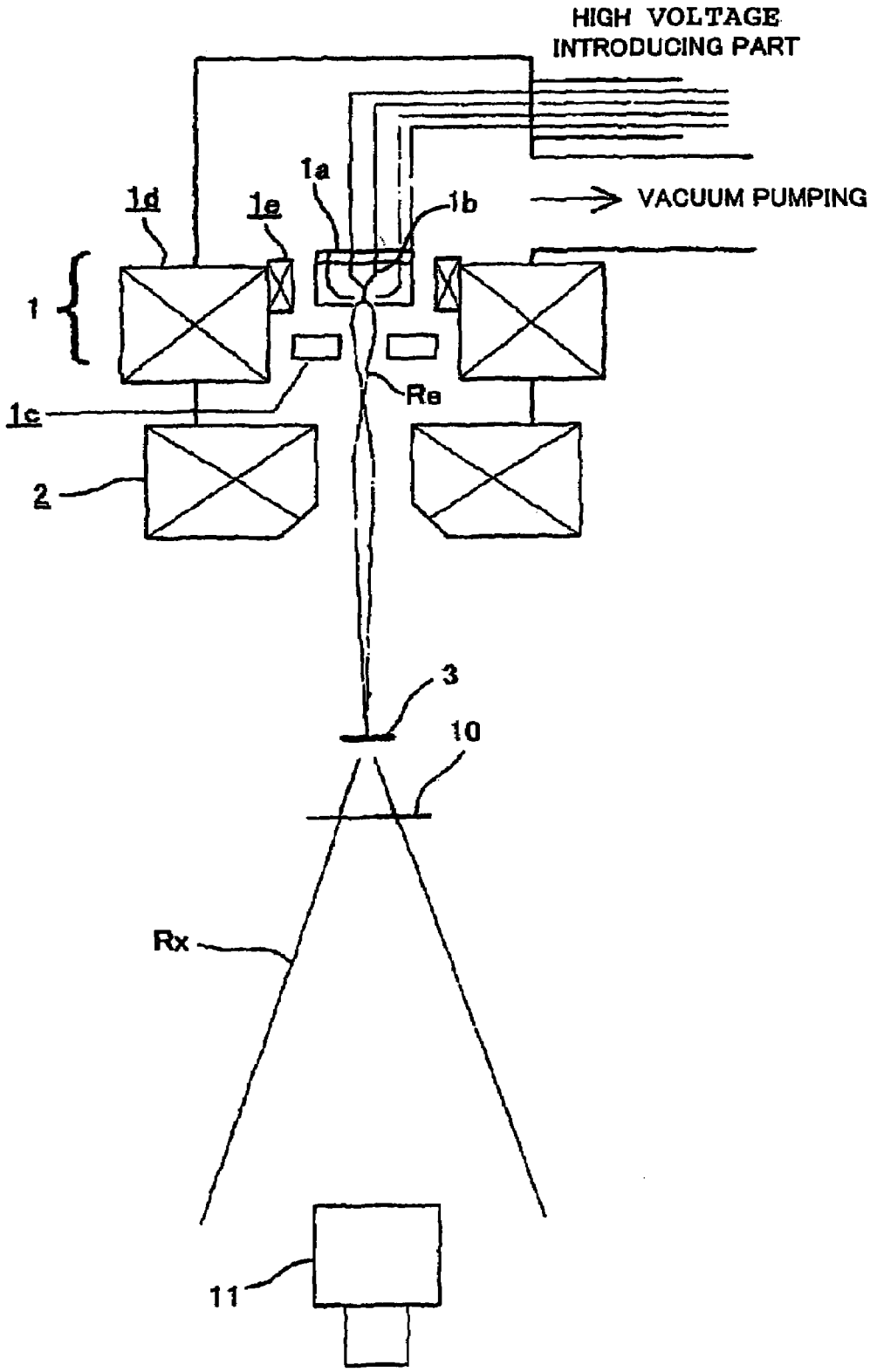
FIG. 3 is a schematic diagram showing an example of a construction of a main part of an X-ray microscopic inspection apparatus according to the invention.

FIG. 3 shows an example of a construction of a main part of an X-ray microscopic inspection apparatus according to the invention, and X-ray generating means includes an electron gun 1, an objective lens 2, a target 3, etc., and the electron gun 1 is constituted by a Schottky module 1*a*, an electron source 1*b*, an anode 1*c*, etc. In the X-ray microscopic inspection apparatus of the invention, as described above, "liquid metal field emission cathode (liquid metal electron source)" or "thermal field emission cathode (thermal field emission electron source)" is used as the electron source 1*b*.

Figure 4A:
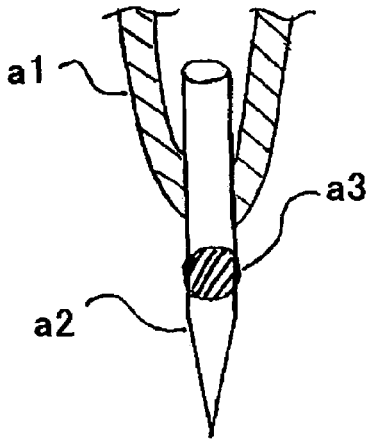
FIGS. 4A and 4B are diagrams showing an example of a liquid metal field emission cathode.
Figure 4B:
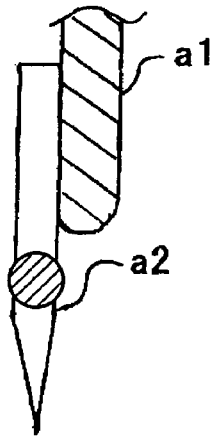

FIGS. 4A and 4B show an example of a liquid metal field emission cathode by diagrams. The liquid metal field emission cathode 1*b* has a construction in which a filament of tungsten is provided as a thermionic source a1 and a tungsten having a tip end formed at an acute angle as shown in FIG. 4A is attached to the thermionic source a1, as an electron generating portion a2 as shown in FIG. 4B, and the electron generating portion a2 is coated with liquid metal a3. By such construction, the liquid metal a3 diffuses along the surface and is supplied to the tip end forming very thin tip called Taylor cone as the electron generating portion a2. The effect provided by the liquid metal a3 causes the increase of electron beam brightness about a hundred times. As the material used as the liquid metal, a material having relatively low vapor pressure at a molten state of the metal having low melting point used in a liquid metal ion source is preferable. For example, In (indium) [melting point≈429 K, vapor pressure at melting point: $<<10^{-10}$ Pa], Ga (gallium) [melting point≈303 K, vapor pressure at melting point: $<<10^{-10}$ Pa], etc. are suitable.

In addition, in the invention, as the construction example in FIG. 3, a construction adopted in which a magnetic superposition lens 1*d* that has never been used for the X-ray microscope is disposed in the vicinity of the electron generating portion of the electron gun 1 of the X-ray microscopic inspection apparatus, and, by superposing the magnetic field formed by the magnetic superposition lens 1*d* on the electric field formed by the electron gun at least from the electron generating portion 1*a* to the anode 1*c* as a component element of electron accelerating means, the electrons Re are focused while accelerating them by the anode 1*c*. That is, the loss amount of the focused electron beams is reduced by accelerating the electron Re just after generated from the electron generating portion 1*a* while focusing them. Then, the focused electron beam (electron probe for X-ray generation) having high current density is impinged on the target 3 so as to increase the X-ray amount generated from the target 3.

The so-called magnetic superposition lens has been conventionally used in an electron beam apparatus such as a transmission electron microscope and a scanning electron microscope, however, the lens can not be applied to the X-ray microscopic inspection apparatus because the desired X-ray amount can not be obtained because of the small emission current amount. The reason for that is, in the electron microscope, the small emission current amount is not problematic to some extent because it is enough as the signal. In the X-ray microscopic inspection apparatus, however, different from the electron microscope, the problem that the image is dark and long exposure time is needed with the small amount of the probe current raises. Especially, short exposure time is a required condition for the widespread industrial use. Further, the electron beam apparatus such as an electron microscope has the construction in which a magnetic circuit etc. is incorporated within the electron gun chamber that requires ultra-high vacuum. In the X-ray microscopic inspection apparatus that requires the greater electron flow (probe current), it is difficult to solve the vacuum deterioration due to the magnetic circuit accompanying gas and heat generation and consequently out-gas that is emitted by the electron flow impingement. On this account, there is no example in which the lens used in the electron beam apparatus is applied to the X-ray inspection apparatus. In the invention, the problem is solved by adopting a material that is thought to emit small amount of gas, and by placing the magnetic circuit outside the vacuum chamber with water cooling for the circuit.

Hereinafter, the construction of the magnetic superposition lens that is unique to the X-ray inspection apparatus according to the invention will be described by comparison with the lens used in the electron beam apparatus such as a scanning electron microscope.

The FE (field emission) electron gun provides electron beams having high brightness and good coherence, and thereby, demonstrates its high performance in a transmission electron microscope, a scanning electron microscope, a scanning transmission electron microscope, an electron beam exposure apparatus, etc. However, this performance is obtained by reducing the crossover of the electron source extremely small. The so-called electron beam probe demonstrates its performance only when the probe is made in a size equal to or less than nanometer (sub-nanometer). However, in order to obtain a probe in which the crossover of the electron source is enlarged from submicron to micron size, it becomes difficult to obtain sufficient probe current due to the large aberration of the magnification lens. This aberration in associated with the distance from the position of the electron source of the electron gun to the first stage of the magnifying lens (single stage or plural stages), and proportional to the third to fourth power of the distance. Therefore, a so-called compound lens in which an electron lens is added to the electron gun part is devised and put into practical use.

Figure 2:
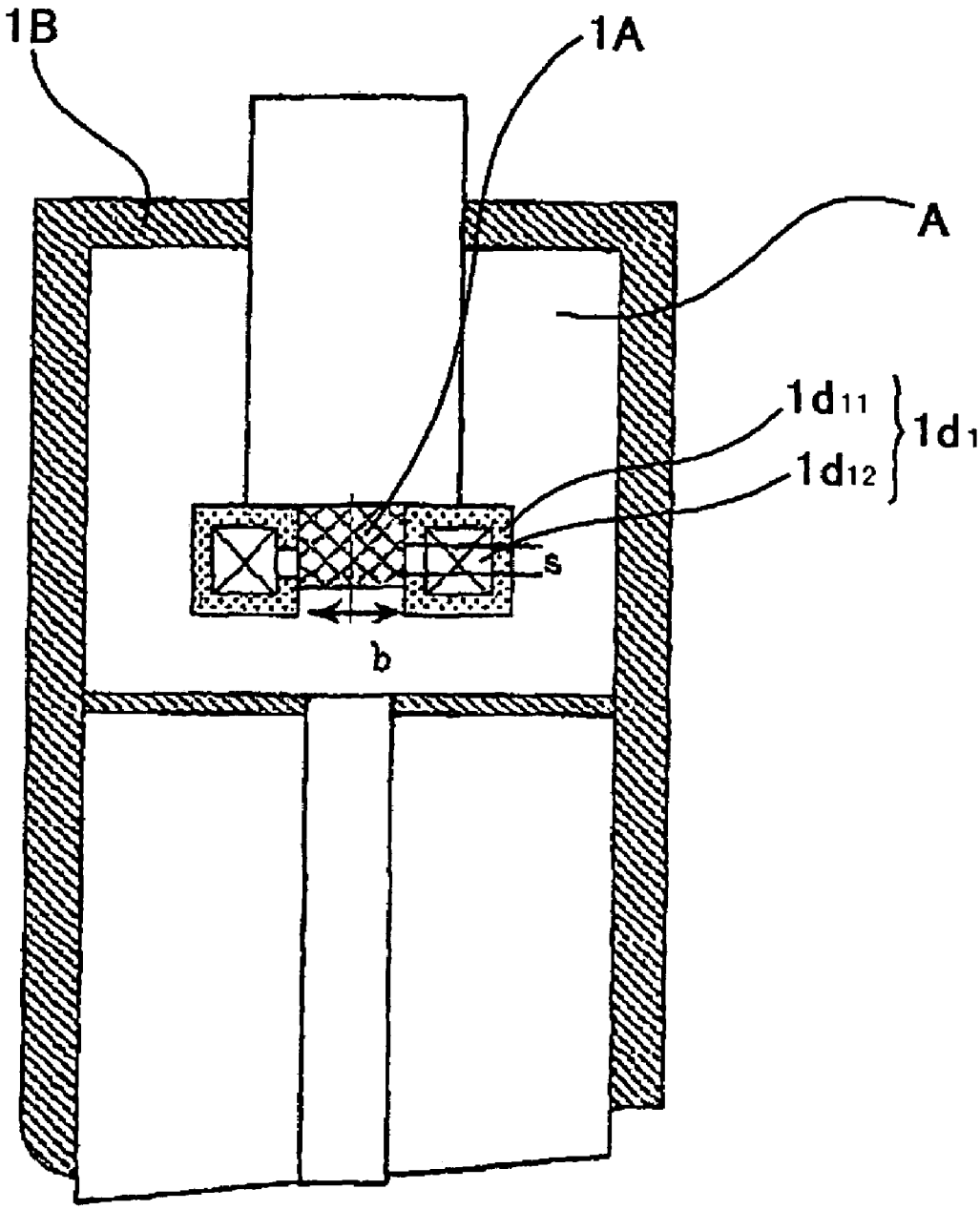
FIG.2 (Prior Art)
FIG. 2 is a diagram showing a construction example of a conventional FE electron gun.

However, the conventional FE electron gun has a construction in which, as shown in the construction example in FIG. 2, the entire housing of the electron gun chamber is made from a vacuum sealing material 1B such as stainless steel, and a magnetic circuit $\mathbf{1}d_1$ (magnetic body $\mathbf{1}d_{11}$, excitation coil $\mathbf{1}d_{12}$, etc.) is incorporated in the electron gun tip end 1A disposed within the ultra-high vacuum thereof. In such construction, there are great difficulties associated with incorporation of the magnetic circuit accompanying heat generation within the FE electron gun chamber A that requires ultra-high vacuum, cooling water, and the magnetic coil, and taking out of lead lines and pipes connected thereto. In addition, the axis alignment mechanism of the electron gun and the electron lens is also extremely difficult. On the contrary, the electron gun for X-ray generation having the magnetic superposition lens (hereinafter, referred to as magnetic superposition electron gun) according to the invention has a construction in which a magnetic field generating portion of the magnetic superposition lens constituted by the magnetic circuit $\mathbf{1}d_1$, etc. is provided in the position in the vicinity of the electron source of the electron gun (electron gun tip end 1A for electron generation) outside the electron gun chamber under vacuum.

Figure 5:
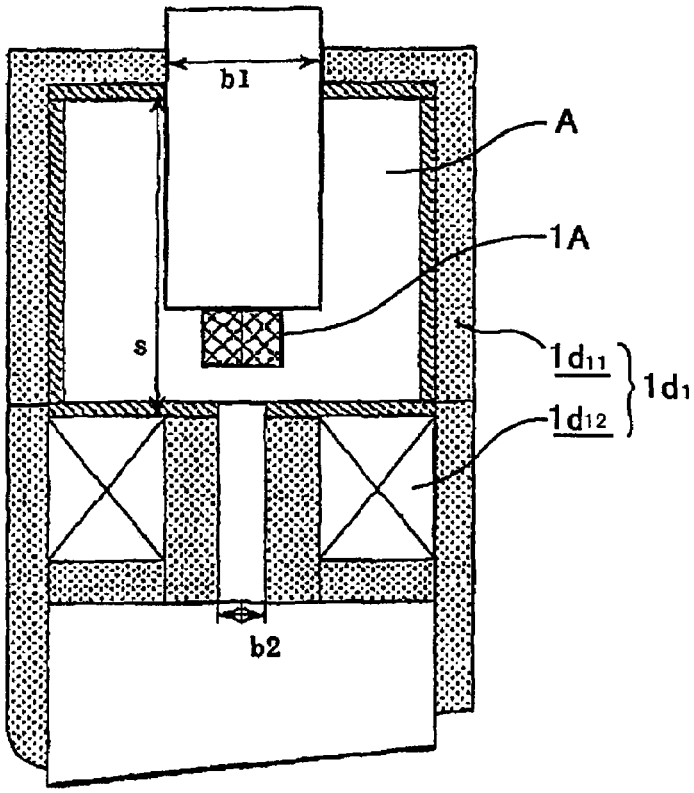
FIG. 5 is a diagram showing a first construction example of a magnetic lens superposition electron gun according to the invention.

FIG. 5 shows a first construction example of the magnetic lens superposition electron gun according to the invention corresponding to the construction of the conventional FE electron gun shown in FIG. 2. 1A denotes the electron gun tip end constituted by an emitter, a suppresser, an extractor, etc., $\mathbf{1}d_1$ denotes the magnetic circuit, $\mathbf{1}d_{11}$ denotes the magnetic body constituting the magnetic circuit, $\mathbf{1}d_{12}$ denotes the excitation coil for the magnetic circuit $\mathbf{1}d_1$, s denotes the distance between two pole pieces of the electron lens, and b2 ("b" in FIG. 2) denotes the hole diameter of the pole piece, respectively. As shown in FIG. 5, in the embodiment, the construction in which the electron gun chamber itself is incorporated in the magnetic circuit $\mathbf{1}d_1$ constituted by the magnetic body $\mathbf{1}\mathrm{d}_{11}$, etc., is adopted. Specifically, the construction includes an electron gun accommodation part having a rectangular section, for example, as shown in FIG. 5, and a housing covering the magnetic body as the electron gun chamber A, as the component element of the magnetic superposition lens 1*d*, and the electron gun incorporated in the electron gun accommodation part. That is, the construction includes the parts of the housing (the entire or a part of the housing such as an upper plate, a bottom plate, and an outer cylinder) provided as a part or the entire of the magnetic circuit (magnetic field generating portion) and the electron gun and the electron lens 1*d* separated under vacuum.

In the first construction example, strong excitation is required, since the object surface (crossover of electron source) is disposed rearward than the center of the lens field, though there is an advantage that the aberration coefficient (especially, the spherical aberration) is made significantly small. The reason for that is, generally, when the distance from the object surface (in this case, crossover of electron source) to the lower pole of the electron lens is fixed, the larger the hole diameter and the distance of the pole pieces, the smaller the spherical aberration becomes. Note that, chromatic aberration is not limited to that, the chromatic aberration can be neglected as the subject of the invention. In addition, since the magnetic circuit is separated from the electron gun chamber that requires ultra-high vacuum in construction, there is an advantage that the vacuum seal, the cooling water, and lead lines can be taken out easily.

Figure 6:
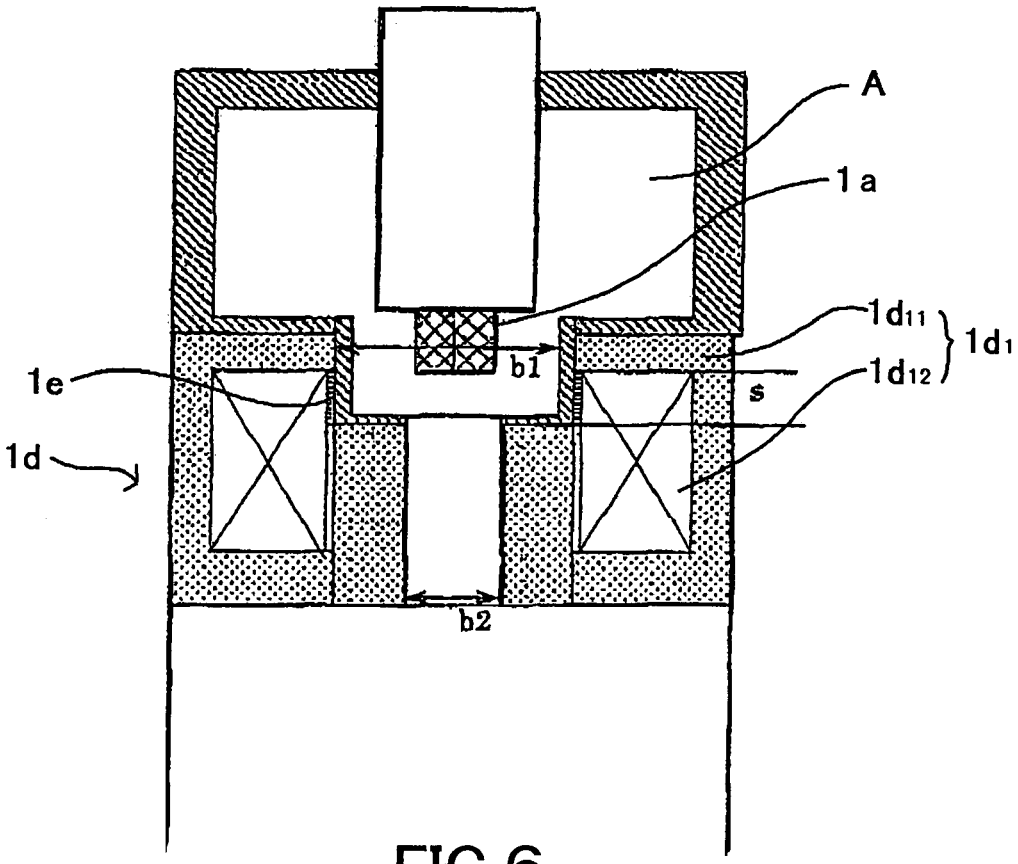
FIG. 6 is a diagram showing a second construction example of a magnetic lens superposition electron gun according to the invention.

FIG. 6 shows a second construction example of the magnetic lens superposition electron gun according to the invention corresponding to the first construction example shown in FIG. 5. In the embodiment, as shown in FIG. 6, the construction in which the electron gun chamber A in the convex form is provided at the upper portion of the magnetic superposition lens 1*d* constituted by the magnetic body $\mathbf{1}d_{11}$ etc. formed so as to have a section in a concaved form, for example, and the electron gun tip end 1A is formed so as to be inserted into the magnetic field from upside of the magnetic superposition lens 1*d*, so that the electron gun tip end 1A and the magnetic body $\mathbf{1}d_{11}$ may be more close, is adopted. Since the extremely strong magnetic excitation is needed in the first construction example shown in FIG. 5, the construction is extremely effective to the low accelerated electron beams, however, not necessarily advantageous for the highly accelerated electron beams to some degree. Therefore, the embodiment adopts the construction in which the hole diameter b of the pole pieces (hole diameters b1 and b2 in different sizes between upper and lower holes in this example) and the distance s are made small so that much weaker excitation may be enough, and the electron gun tip end 1A is formed so as to be inserted into its magnetic field.

In both of the above described first and second construction examples of the magnetic lens superposition electron gun, the magnetic superposition lens has the construction in which the magnetic field generating point is disposed in the position in the vicinity of the electron generating portion of the electron gun outside the electron gun chamber, and thereby, there are advantages that the electron gun and the electron lens are separated under vacuum (easy to realize ultra-high vacuum including baking out) and the electric field formed by the electron gun and the magnetic field formed by the electron lens are superposed with no difficulty. In addition, in the construction of FIG. 6, as the example thereof is shown, a deflection coil 1*e* can be easily provided in the vicinity of the electron gun tip end 1A for the electromagnetic axis alignment.

As an electron beam focusing, the above described magnetic superposition lens 1*d* and the electron lens (objective lens) 2 as shown in FIG. 3 are needed. By providing the objective lens 2 to make the focusing of the electron beam by two stages, the freedom of selecting the desired electron probe size and the probe current becomes extremely increased. In addition, since the focal length of the objective lens 2 is longer in the X-ray microscopic inspection apparatus of the invention compared to that in the conventional apparatus (see FIG. 1), the longer working distance (several centimeters) that can be never obtained by the conventional X-ray microscopic inspection apparatus can be realized. On this account, the space between the objective lens 2 and the target 3 can be taken broader, peripheral equipment for the inspection can be provided within the space.

Further, it is essentially important that the X-ray amount applied to the sample (object to be inspected) 10 is greater in order to realize an X-ray microscopic inspection apparatus with high resolving power, so as to make greater electron amount to impinge on the target 3 with high intensity and micro focal point size by a high performance lens. The orientation of the axis and the position of the electron beam for X-ray generation are also important. In the embodiment, as illustrated in FIG. 3 and FIG. 6, the apparatus has the construction in which the electron beam axis alignment coil 1*e* is disposed in the vicinity of the electron generating portion 1*a* (close by the electron source) for the first time as the X-ray microscopic inspection apparatus, and by shifting the electron beam before acceleration by the anode 1*c* in X and Y directions to align the electron beam using the axis alignment coil 1*e*. The axis alignment of the electron beam for the X-ray source can be performed precisely and extremely easily.

Further, as the target 3 shown in FIG. 3, a thin diamond plate that has enough transparency to X-ray, has extremely high thermal conductivity despite that it is an insulative material, and has extremely high melting point is used as a heat sink is adopted. The following Table 1 shows properties of Be (beryllium) and diamond. Since diamond has extremely higher thermal conductivity and melting point compared to Be, which has conventionally used, the problem of melting or evaporation of the target does not occur because of the advantageous effect as the heat sink even if the electron probe having high current density is focused by the magnetic superposition lens 1*d*.

TABLE 1

| | Be | Diamond |
|---|---|---|
| Melting point (K) | 1551 | 3873 |
| Density ($kgm^{-3}$) | 1847.7 [293 K] | 3510 [293 K] |
| Thermal conductivity ($Wm^{-1}K^{-1}$) | 200 [300 K] | 1540 [400 K] |
| Electric conductivity ($\Omega^{-1}m^{-1}$) | $2.5 \times 10^{7}$ [293 K] | $3.7 \times 10^{-5}$ [293 K] |

Figure 7A:
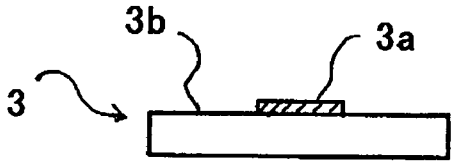
FIGS. 7A and 7B are diagrams showing an example of a target with a diamond heat sink.
Figure 7B:
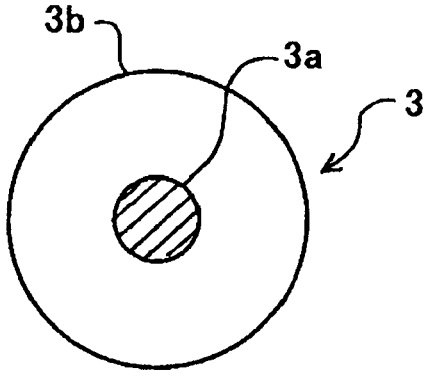

FIGS. 7A and 7B schematically show an example of the target 3 with a diamond heat sink by the side view and plan view. As shown in FIG. 7A, for example, the target has a construction in which, on the diamond plate 3*b* formed in the form of a thin plate by CVD, the target material 3*a* is deposited by CVD. Thus, by making the target with CVD diamond as the heat sink, the temperature rise of the target 3 due to the electron beam is largely reduced, to endure a high intensity X-ray generation. The target 3 is kept in the electrically conductive state to the column at the earth potential with thin conductive layer such as Be to avoid the charging up due to the insulative diamond plate.

By the above described construction, the X-ray microscopic inspection apparatus having ultra-high resolving power of 40 nm to 100 nm can be realized, and the apparatus can contribute to non-destructive inspections etc. in various fields such as the inspection of the next generation very large scale integrated circuit, the inspection of the components of the medical micromachine, the inspection of the sample consisted principally of a light element by an X-ray having a long wavelength (0.2 to 3 nm).

As described above, according to the invention, an X-ray microscopic inspection apparatus capable of performing non-destructive inspection of the object can be performed with ultra-high resolving power (40 to 100 nm) better than 0.1 μm. Specifically, since the electron beam for X-ray generation having high current density is formed by using the magnetic superposition lens, and greater X-ray amount is generated, the apparatus can be operated as a higher magnification system of several times as a whole, while avoiding the electron beam loss. In addition, by the construction in which liquid metal or thermal field emission cathode is used for the electron source, the electron source with higher brightness and greater emission current amount compared to the conventional electron source using the $LaB_6$ cathode can be obtained, and the X-ray amount applied to the object to be inspected can be largely increased.

Further, by the construction in which CVD diamond is used as a heat sink of the target for X-ray generation, the temperature rise when the energy of the electron beam is converted into heat on the target can be largely reduced, and as a result, the target can endure the thermal load even if the X-ray amount applied to the object to be inspected is largely increased.

Furthermore, as described in "Description of the Related Art", the miniaturization of the minimum constitutional unit of the semiconductor component is recently being promoted from the micro-scale to nano-scale. The non-destructive inspection of the microstructure inside such components will be a necessary and indispensable technology in the future. Only an X-ray can be used for non-destructive inspection with high resolving power of such inner structure. Therefore, the invention that enables the non-destructive inspection with ultra-high resolving power of 40 nm to 100 nm can largely contribute to the nano-technology fields.

What is claimed is:

1. An X-ray microscopic inspection apparatus having X-ray generating means for generating an X-ray by allowing an electron beam from an electron source to impinge on a target for X-ray generation, for inspecting an object by utilizing said X-ray, said X-ray microscopic inspection apparatus comprising:

a field emission electron gun having an ultra-high vacuum electron gun chamber, an anode and an electron generating portion, wherein the electron generating portion is adapted to generate electrons and said anode is adapted to generate an electric field to accelerate said electrons;

said field emission electron gun further comprising a magnetic superposition lens including a magnetic circuit and a magnetic field generating portion, wherein said magnetic field generating portion is disposed separately from said ultra-high vacuum electron gun chamber and said magnetic superposition lens is adapted to generate a magnetic field, wherein said electron generating portion is disposed in said magnetic field and said magnetic field is superposed to said electric field thereby reducing the loss amount of said electron beams from said electron source by focusing the accelerated electrons prior to being impinged on said target for X-ray generation.

2. The X-ray microscopic inspection apparatus according to claim 1, wherein the electron source is a liquid metal electron source utilizing liquid metal.

3. The X-ray microscopic inspection apparatus according to claim 1, wherein the electron source is a thermal field emission electron source.

4. The X-ray microscopic inspection apparatus according to claim 1, wherein the target for X-ray generation is a target with a heat sink using thin CVD diamond plate as the heat sink.

5. The X-ray microscopic inspection apparatus according to claim 1, wherein the electron gun chamber of ultra-high vacuum is covered by the magnetic circuit.

6. The X-ray microscopic inspection apparatus according to claim 1, wherein the electron gun chamber is formed in the convex form, a section of the magnetic body of the magnetic generation portion is formed in a concaved form, and the electron generating portion of the electron gun is disposed in said concaved portion to that said electron generating portion and said magnetic generating portion become more close.

7. The X-ray microscopic inspection apparatus according to claim 1, wherein an accelerating voltage applied to the electron gun is within the range of 10 to 20 kV, and the focused electron beam is impinged to the target for the X-ray generation composed of germanium or chromium so that a characteristic X-ray having a wavelength of 0.2 to 3 nm.

8. The X-ray microscopic inspection apparatus according to claim 1, further comprising an electron lens disposed between the magnetic superposition lens and the target so that the electron beam is focused by two stages through said magnetic superposition lens and said electron lens.

* * * * *